US005256035A

United States Patent [19]

Norris et al.

[11] Patent Number: 5,256,035

[45] Date of Patent: Oct. 26, 1993

[54] ROTOR BLADE RETENTION AND SEALING CONSTRUCTION

[75] Inventors: James W. Norris, Jupiter; James Hurchala, Stuart, both of Fla.; Noel H. Davis, Atlanta, Ga.

[73] Assignee: United Technologies Corporation, Hartford, Conn.

[21] Appl. No.: 891,141

[22] Filed: Jun. 1, 1992

[51] Int. Cl.[5] ..... F01D 5/32

[52] U.S. Cl. ..... 416/220 R

[58] Field of Search ..... 416/219 R, 220 R, 221

[56] References Cited

U.S. PATENT DOCUMENTS

| | | | |
|---|---|---|---|
| 3,181,835 | 5/1965 | Davis | 416/219 R |
| 3,644,058 | 2/1972 | Barnabei et al. | 416/219 R |
| 3,656,865 | 4/1972 | Spears, Jr. . | |
| 3,807,898 | 4/1974 | Guy et al. . | |
| 3,814,539 | 6/1974 | Klompas . | |
| 3,853,425 | 12/1974 | Scalzo et al. . | |
| 4,108,571 | 8/1978 | Mawson . | |
| 4,349,318 | 9/1982 | Libertini et al. . | |
| 4,389,161 | 6/1983 | Brumen . | |
| 4,648,799 | 3/1987 | Brown et al. | 416/220 R |
| 4,730,983 | 3/1988 | Naudet et al. | 416/221 |
| 5,139,389 | 8/1992 | Eng et al. | 416/219 R |

FOREIGN PATENT DOCUMENTS

| | | | |
|---|---|---|---|
| 1295003 | 11/1972 | United Kingdom | 416/220 R |

*Primary Examiner*—Edward K. Look
*Assistant Examiner*—Christopher Verdier
*Attorney, Agent, or Firm*—Russell M. Lipes, Jr.

[57] ABSTRACT

A rotor and blade assembly for a gas turbine engine in which blades are retained in position on the rotor by a plurality of circumferentially extending segment plates and a snap ring, the segment plates extending radially between a circumferential groove in the rotor and the underside surface of a blade platform and extends circumferentially to seal at least two blade roots, and the snap ring is installed in a groove on the underside of the blade platform and external of the platform surface contacted by a segment plate, the snap ring covering the outer peripheral portion of the segment plates.

4 Claims, 3 Drawing Sheets

ROTOR BLADE RETENTION AND SEALING CONSTRUCTION

TECHNICAL FIELD

This invention relates to gas turbine engines and more specifically to the retention and sealing of rotor blades.

BACKGROUND ART

In the gas turbine engine field, compressor and turbine rotors consist of a number of axially spaced rotors each having a plurality of radially extending blades and each alternating with rows of radially extending stator vanes. The working medium gases in the engine flow alternately through rows of rotor blades and rows to stator blades. Each rotor blade has a lower portion or root which is inserted axially into a similarly shaped opening or notch in the periphery of the rotor. Typically, the upstream surface of a rotor blade has a flange for engagement with the rotor periphery limiting axial movement of the blade in a downstream direction and a split ring or sideplate retainer is employed to limit axial movement of the blade in an upstream direction, thus locking the blade in position.

Among the problems experienced with various rotor blade retention constructions and designs is the requirement to remove more than one blade if it becomes necessary to replace a blade. Further, it has been difficult to seal the interface between the blade root and the rotor and minimize gas leakage from the higher pressure downstream side of a compressor rotor to the lower pressure upstream side of the rotor.

It is known to use a split ring to position and retain the rotor blades in position on the rotor. The ring is typically positioned in an annular groove in the periphery of the rotor and in the blade roots, and has a loading slot for installation of the blades. Another retention system which has been employed invokes the use of side plates or segments which sometimes are affixed to the rotor. In addition, to the systems used to retain and seal the blades installed on a rotor, damping of vibratory stresses sometimes is achieved by the use of damper weights in spaces between the blade roots and the rotor.

One of the problems with known systems is that removal and replacement of a single blade or weight sometimes requires that more than one blade be removed to replace a single blade or weight. Another problem is that shrouded blades cannot be used in systems which employ a loading slot.

U.S. Pat. No. 4,730,983 discloses a rotor blade locking and sealing system using two split rings, but the system requires a loading slot and cannot be used for shrouded blade designs. U.S. Pat. No. 3,888,601 uses a snap ring to retain rotor blades, and U.S. Pat. No. 4,566,857 employs circumferentially extending scalloped pins to lock and seal rotor blades.

Because of the importance of simplicity of maintenance and assembly of jet engines as well as the minimization of pressure losses, improvements in jet engine construction are constantly being sought.

DISCLOSURE OF THE INVENTION

An object of the invention is a retention and sealing construction for jet engine rotors which is relatively simple and can be used with any style of blade.

Another object of the invention is a retention and sealing construction for jet engine rotors which does not require the use of special loading features such as a slot.

The foregoing and other objects, features and advantages will be apparent from the specification and claims and from the accompanying drawings which illustrate an embodiment of the invention.

BEST MODE FOR CARRYING OUT THE INVENTION

Figure 1:
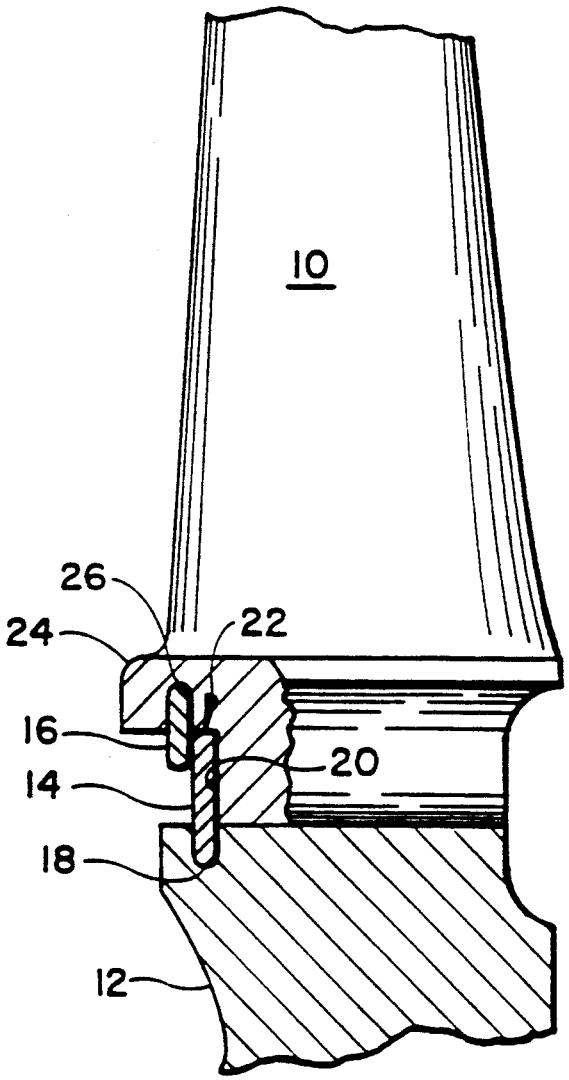
FIG. 1 is an axial section view of a portion of a rotor and rotor blade incorporating the retention and sealing construction of this invention.

In FIG. 1, rotor blade 10 is shown in position on rotor 12, and the blade having been inserted in a notch on the periphery of the rotor. The blade is retained in axial position by segment plate 14 and snap ring 16. The segment plate has a circumferential dimension or width sufficient to cover several blades, the width being a matter of designers choice, and the snap ring typically is a one-piece member. Once blades have been positioned on the rotor, segment plates 14 are installed. Each segment plate is installed by inserting its lower or circumferentially inner edge into groove 18 around the periphery of rotor 12 immediately below the rotor blade notches. The upper portion of the segment plate is then pushed into position so that the inner face of the segment plate is against blade root face 20 and the upper edge of the segment plate is adjacent inner surface 22 of blade platform 24. The depth of rotor groove 18 and the height of segment plates 14 are dimensionally related. The groove must be sufficiently deep to restrain the segment plate against fore and aft or axial movement. The segment plate must be sufficiently high to essentially occupy the distance between the bottom of groove 18 and blade platform inner surface 22 as well as provide a circumferential face area overlapping snap ring 16. The snap ring fits into groove 26 in the inner surface of platform 24 of each of the rotor blades and it covers the outer periphery portion of the segment plate.

Figure 2:
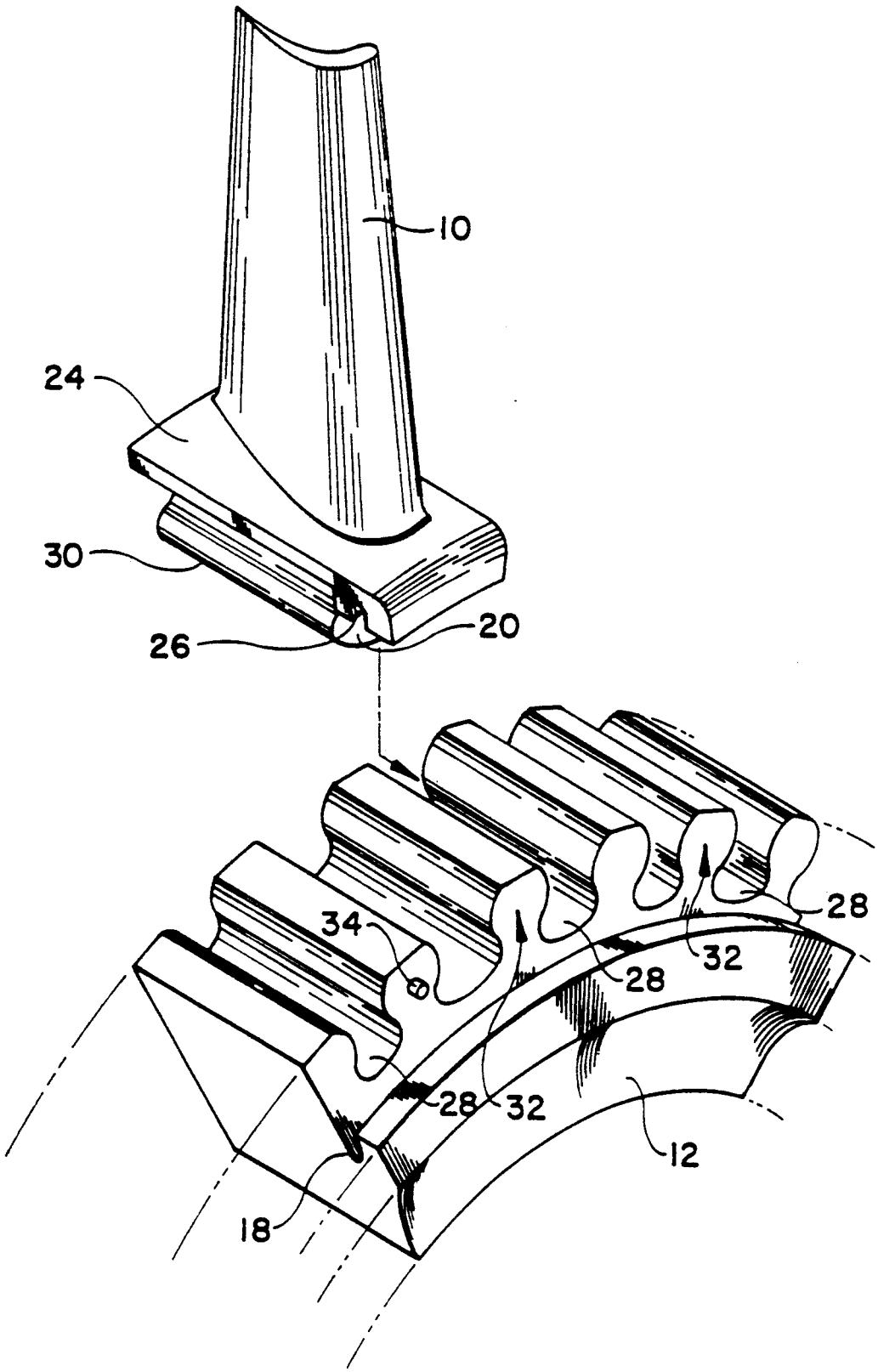
FIG. 2 is an enlarged, perspective view of the rotor of FIG. 1 and a rotor blade.

FIG. 2 shows a peripheral portion of rotor 12 and a plurality of notches 28 for receiving rotor blades such as blade 10. Blade platform 24 can be seen with groove 26 in the underside or inner surface of the front edge of the platform. Blade root 30 is contoured to fit within notch 28 and when in assembled position blade root face 20 will be flush with rotor face 32. When all of the blades are in position, segment plates are inserted in rotor groove 18 about the rotor periphery and the snap ring is installed in rotor blade grooves 26. At one or more locations around the periphery of the rotor, anti-rotation pins 34 may be installed in rotor face 32 between grooves.

Figure 3:
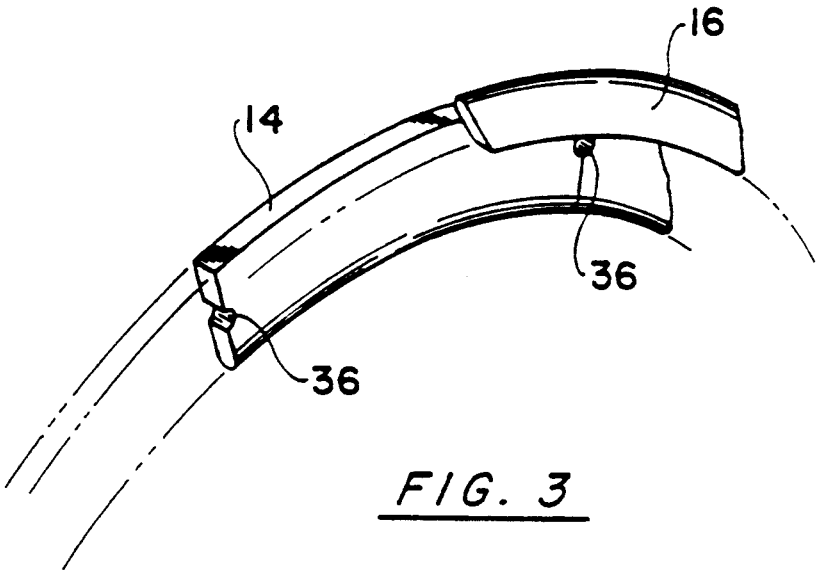
FIG. 3 is a view of a segment plate.

As seen in FIG. 3, any segment plate 20 may have semi-circular notch 36 at each end to fit over anti-rotation pins 34 if required. A portion of snap ring 16 is shown as it would cover the outer peripheral portion of the segment plates. Each segment plate is sufficiently wide to cover a plurality of blade root faces 20 around the rotor periphery and completely seal the interface between the root and its groove against gas leakage. The ends of each segment plate coincide with the middle of the rotor portion between notches 28 and it is at one or more of these notch midportions where anti-rotation pin 34 is located.

Figure 4:
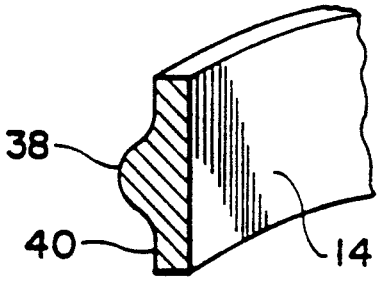
FIG. 4 is a view of a weighted segment plate.

Because of the system structure, it is possible to use the segment plates as classed balance weights to establish dynamic balance of the rotor. FIG. 4 is an end view of segment plate 14 having a mass 38 added to its outer face 40. The circumferential extent and size of mass 38 may be varied so that a range of balance weights is available. It is essential to use the anti-rotation pins when the segment plates are used as balance weights.

The ring segment blade retention and sealing system described above does not limit blade installation to one blade at a time and allows any type of blade to be used including shrouded blades. Also, it allows each segment plate with an anti-rotating feature to be used as a balance weight. Further, since a loading slot is not involved, there is no need for a locking device to block the loading slot.

It should be understood that the invention is not limited to the particular embodiments shown and described herein, but that various changes and modifications may be made without departing from the spirit or scope of this concept as defined by the following claims.

We claim:

1. A rotor for a gas turbine engine, said rotor having a plurality of notches about its periphery, rotor blades mounted in said notches about said rotor periphery, a circumferential groove around said rotor and immediately below said notches, each rotor blade having a root and platform means above said root, said root conforming in exterior shape to said rotor notches, said platform having at one end a portion overhanging said root and an underside surface having circumferentially extending groove means, a plurality of circumferentially extending segment plates for retaining said blades in position on said rotor, the lower edge of each segment plate being contained within said rotor groove, the back face of each segment plate being adjacent a face of said blade root and the upper edge of each segment plate being adjacent the underside surface of said overhanging platform portion between said platform groove means and said blade root face, each segment plate extending between the rotor midportion between two adjacent rotor notches and the rotor midportion between two other adjacent notches and covering at least two blade roots, segment plate anti-rotation means installed at at least one rotor location between adjacent rotor notches, the ends of said segment plates adjacent said anti-rotation means being contoured about said anti-rotation means, and circumferential ring means contained in part in said blade platform groove means and covering the outer periphery of said segment plates.

2. A rotor and blade assembly for a gas turbine engine in accordance with claim 1 in which at least one segment plate has an added weight mass for rotor balancing.

3. A rotor for a gas turbine engine, said rotor having a plurality of notches about its periphery, rotor blades mounted in said notches about said rotor periphery, a circumferential groove around said rotor and immediately below said notches, each rotor blade having a root and platform means above said root, said root conforming in exterior shape to said rotor notches, said platform having at one end a portion overhanging said root and an underside surface having circumferentially extending groove means, a plurality of circumferentially extending segment plates for retaining said blades in position on said rotor, the lower edge of each segment plate being contained within said rotor groove, the back face of each segment plate being adjacent a face of said blade root and the upper edge of each segment plate being adjacent the underside surface of said overhanging platform portion between said platform groove means and said blade root face, circumferential ring means contained in part in said platform groove means and covering the outer peripheral portion of said segment plates, and anti-rotation means employed on said rotor between the ends of said segment plates, the ends of said segment plates being contoured to accommodate said anti-rotation means.

4. A gas turbine engine rotor and rotor blade assembly in accordance with claim 3 in which at least one anti-rotation pin is installed in said rotor between two adjacent rotor notches and a segment plate is on either side of said pin with adjacent ends of each segment plate contoured to fit around said pin.

* * * * *